US008620182B2

(12) United States Patent
Suzuki

(10) Patent No.: US 8,620,182 B2
(45) Date of Patent: Dec. 31, 2013

(54) DUSTPROOF STRUCTURE USED IN IMAGE FORMING DEVICE

(75) Inventor: Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 627 days.

(21) Appl. No.: 12/687,461

(22) Filed: Jan. 14, 2010

(65) Prior Publication Data

US 2010/0209142 A1 Aug. 19, 2010

(30) Foreign Application Priority Data

Feb. 18, 2009 (JP) ..... 2009-035555

(51) Int. Cl.
*G03G 15/20* (2006.01)

(52) U.S. Cl.
USPC ..... 399/122; 399/322

(58) Field of Classification Search
USPC ..... 399/67, 69, 92, 94, 122, 322
See application file for complete search history.

(56) References Cited

U.S. PATENT DOCUMENTS 5,732,309 A * 3/1998 Okuno et al. ..... 399/68
2009/0245906 A1* 10/2009 Jeong et al. ..... 399/388

FOREIGN PATENT DOCUMENTS

JP 4-314061 A 11/1992
JP 6-236128 A 8/1994
JP 08-185076 7/1996
JP 2002-296948 10/2002
JP 2003-201053 A 7/2003
JP 2003-255748 A 9/2003
JP 2006-078745 A 3/2006

OTHER PUBLICATIONS

Japanese Office Action mailed Dec. 28, 2010 in Japanese Application No. 2009-035555 and English translation thereof.

* cited by examiner

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

An image forming device has a housing, a cover, a frame, a heating member, a transfer roller, a first shaft, and a shielding assembly. The housing has an opening. The cover opens and closes the opening. The frame is provided in the housing. The heating member is supported to the frame and heating a recording sheet. The transfer roller is rotatably positioned between the heating member and the opening in the frame. The transfer roller conveys the recording sheet in a sheet conveying direction and is positioned downstream of the heating member in the sheet conveying direction. The first shaft is rotatable about a first axis extending in a first direction perpendicular to the sheet conveying direction. The first shaft supports the transfer roller and facing the frame through a gap through which the sheet passes. The heating member is exposed to the opening through the gap. The shielding assembly extends in the first direction and is movable between a first position where at least a part of the shielding assembly is aligned with the gap in the sheet conveying direction and a second position where the shielding assembly is offset from the gap in the sheet conveying direction.

15 Claims, 5 Drawing Sheets

DUSTPROOF STRUCTURE USED IN IMAGE FORMING DEVICE

CROSS REFERENCE TO RELATED APPLICATION

This application claims priority from Japanese Patent Application No. 2009-035555 filed on Feb. 18, 2009. The entire content of this priority application is incorporated herein by reference.

TECHNICAL FIELD

The present invention relates to an image forming device provided with a thermal member which heats a recording sheet.

BACKGROUND

A conventional image forming device has a main housing having a rear opening on the back side, a rear cover to close the rear opening, and a heating roller in the main housing to heat a recording sheet. In this image forming device, the heating roller is generally exposed to the rear opening when the rear opening is opened by the rear cover.

SUMMARY

In the conventional image forming device, when the rear opening is opened by the rear cover, dust may enter into the inside of the main housing and be adhered to the surface of the heating roller. The dust on the heating roller may affect quality of image on the recording sheet.

An object of the invention is to provide an image forming device which reduces adhere of dust onto the heating roller and then improves image quality of image on the recording sheet.

The present invention provides an image forming device having a housing, a cover, a frame, a heating member, a transfer roller, a first shaft, and a shielding assembly. The housing has an opening. The cover opens and closes the opening. The frame is provided in the housing. The heating member is supported to the frame and heating a recording sheet. The transfer roller is rotatably positioned between the heating member and the opening in the frame. The transfer roller conveys the recording sheet in a sheet conveying direction and is positioned downstream of the heating member in the sheet conveying direction. The first shaft is rotatable about a first axis extending in a first direction perpendicular to the sheet conveying direction. The first shaft supports the transfer roller and facing the frame through a gap through which the sheet passes. The heating member is exposed to the opening through the gap. The shielding assembly extends in the first direction and is movable between a first position where at least a part of the shielding assembly is aligned with the gap in the sheet conveying direction and a second position where the shielding assembly is offset from the gap in the sheet conveying direction.

The present invention further provides a fixing device for fixing image on a recording sheet, having a frame, a heating member, a transfer roller, a first shaft, and a shielding assembly. The frame has a first opening and a second opening. The heating member is positioned in a proximity of the first opening and heating the recording sheet. The transfer roller rotatably positioned between the heating member and the second opening. The transfer roller conveys the recording sheet in a sheet conveying direction and positioned downstream of the heating member in the sheet conveying direction. The first shaft is rotatable about an axis extending in a first direction perpendicular to the sheet conveying direction. The first shaft supports the transfer roller and facing the frame through a gap through which the sheet passes. The heating member is exposed to the second opening through the gap. The shielding assembly extends in the first direction and is movable between a first position where at least a part of the shielding assembly is aligned with the gap in the sheet conveying direction and a second position where the shielding assembly is offset from the gap in the sheet conveying direction.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
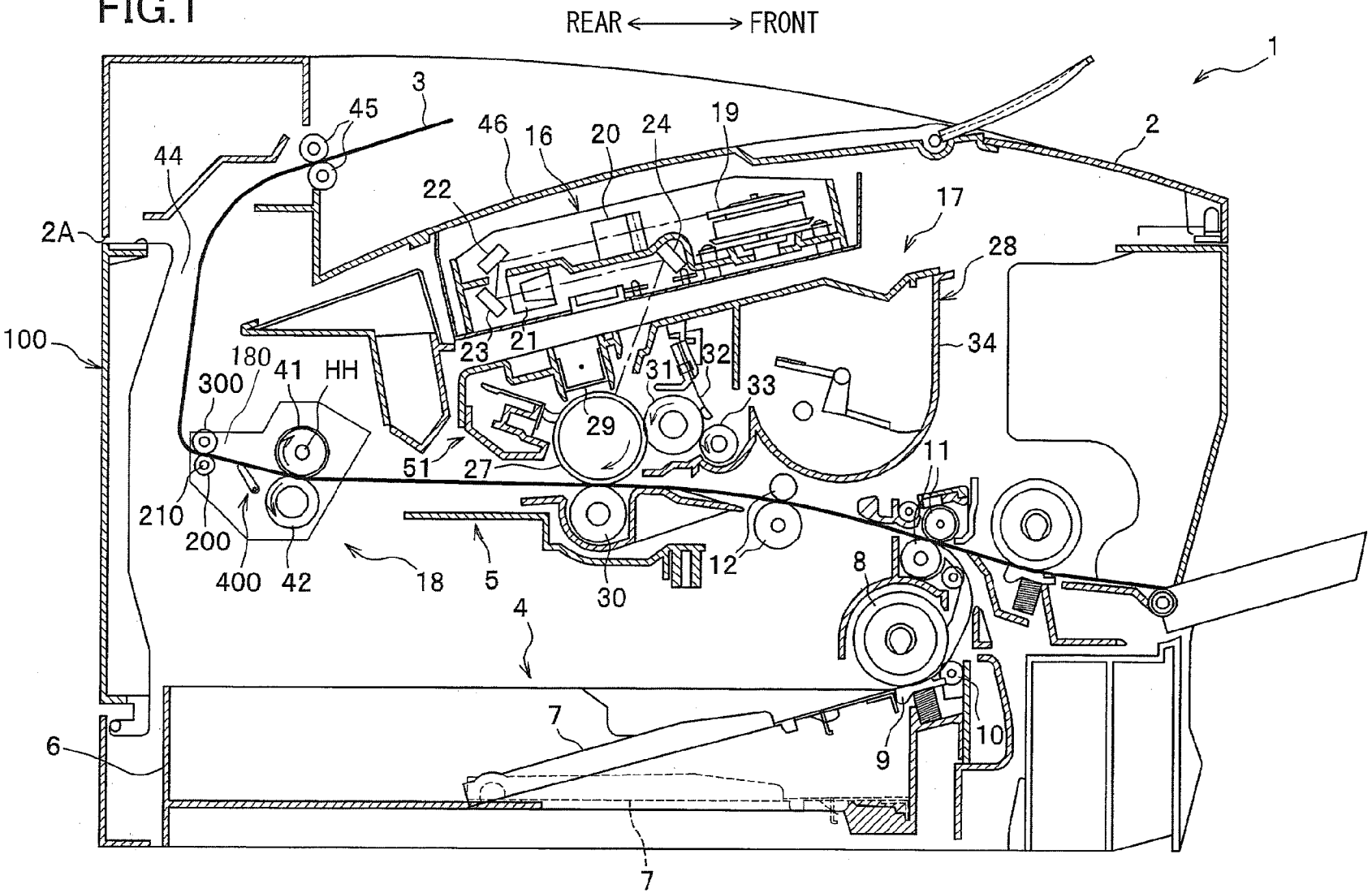
FIG. 1 is a side sectional view showing a laser printer according to an embodiment of the present invention.

An image forming device according to embodiments of the invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the image forming is disposed in an orientation in which it is intended to be used, without any specific restriction.

1. General Structure of Laser Printer

FIG. 1 shows a laser printer 1 having a feeder unit 4 for feeding a sheet 3 and an image forming unit 5 for forming an image on the sheet 3 fed by the feeder unit 4 in a main housing 2. The main housing 2 has an opening 2A on a rear side surface thereof and a rear cover 100 for closing and opening the opening 2A. The rear cover 100 is pivotably attached to the main housing 2.

The feeder unit 4 includes a paper tray 6 and a sheet pressing plate 7. The paper tray 6 is loadable in the bottom part of the main housing 2. The sheet pressing plate 7 is provided in the paper tray 6. The feeder unit 4 further includes a sheet feeding roller 8 and a sheet feeding pad 9 provided above one end of the paper tray 6, paper dust removing rollers 10 and 11 provided downstream of the paper feeding roller 8 along a sheet conveying path. The sheet 3 is conveyed along the sheet conveying path. In this embodiment, the direction of the sheet 3 conveyed along the sheet conveying path is designated as a sheet conveying direction. The feeder unit 4 further includes a register roller 12 provided downstream of the paper dust removing rollers 10 and 11 in the sheet conveying direction.

In the above configured feeder unit 4, the sheet 3 is urged toward the sheet feeding roller 8 by the sheet pressing plate 7. The sheet 3 is then fed by the sheet feeding roller 8 and the sheet pressing pad 9 one sheet at a time, and transferred to the image forming unit 5 through each of rollers 10-12.

The image forming unit 5 includes an optical scanning unit 16, a processing cartridge 17, and a fixing unit 18.

The optical scanning unit 16 is provided in the upper portion of the main housing 2, and includes a laser generator (not shown), a rotatably driven polygon mirror 19, lenses 20 and 21, and reflecting mirrors 22, 23, and 24. In the optical scanning unit 16, a laser beam emitted from the laser generator travels to a surface of a photosensitive drum 27 in the processing cartridge 17 and scans image thereon at a high speed.

The processing cartridge 17 is positioned under the optical scanning unit 16 and detachable with respect to the main housing 2. The processing cartridge 17 mainly includes a developing cartridge 28 and a drum unit 51.

The developing cartridge 28 includes a developing roller 31, a thickness-regulating blade 32, a supply roller 33, and toner hopper 34. After toner in the toner hopper 34 is agitated by agitator, the toner is supplied to the developing roller 31 by the supply roller 33 and then positively and frictionally charged between the supply roller 33 and the developing roller 31. The toner which has been supplied on the developing roller 31 is sent to a space defined between the thickness-regulating blade 32 and the developing roller 31 and then carried on the developing roller 31 so as to have a uniform thickness.

The drum unit 51 includes the photosensitive drum 27, a scorotron charger 29, and a transfer roller 30. In the drum unit 51, the surface of the photosensitive drum 27 is positively charged uniformly by the scorotron charger 29 and then scanned by the laser beam from the optical scanning unit 16. Thus, an electrostatic latent image based on image data is formed on the exposed portion of the surface of the photosensitive drum 27, because the exposed portion has a lower electric potential. Next, when the toner carried on the photosensitive roller 31 comes to contact with the photosensitive drum 27 due to the rotation of the developing roller 31, the toner is supplied to the electrostatic latent image formed on the surface of the photosensitive drum 27. Because the toner is selectively carried on the surface of the photosensitive drum 27 to be visualized, the toner image is formed on the photosensitive drum 27 due to the reverse phenomenon.

After that, the photosensitive drum 27 and the transfer roller 30 are driven so as to sandwich and transfer the sheet 3 therebetween. The sheet 3 is transferred between the photosensitive drum 27 and the transfer roller 30. Therefore, the toner image carried on the surface of the photosensitive drum 27 is transferred on the sheet 3.

The fixing unit 18 includes a halogen heater HH as a heat source, a cylindrical heating roller 41 as a heating member, a pressure roller 42, a transfer roller 200, a pinch roller 300, and a closing member 400 in a frame 180.

The halogen heater HH is provided in the cylindrical heating roller 41 and heats the heating roller 41 from the inside thereof.

The heating roller 41 has a cylindrical shape made from a metallic material, and is rotatably supported to a frame of the fixing unit 18. In this embodiment, the heating roller 41 has a cylindrical surface made from aluminum and coated with polytetrafluoroethylene (PTFE) such as TEFLON (registered trademark).

The pressure roller 42 is pressed to the heating roller 41 with a spring (not shown) to contact with the heating roller 41 and follow the rotation of the heating roller 41. In this embodiment, the pressure roller 42 is formed by surrounding a core with urethane rubber and covering a surface of urethane rubber with a TEFLON (registered trademark) tube.

The transfer roller 200 and the pinch roller 300 are positioned so as to face each other in a vertical direction between the heating roller 41 and the rear cover 100. The transfer roller 200 and the pinch roller 300 are rotatably supported to the frame 180 of the fixing unit 18. The transfer roller 200 and the pinch roller 300 sandwich and transfer the sheet 3 to the downstream of the sheet conveying direction. The details of the transfer roller 200, the pinch roller 300, and the closing member 400 will be described later.

In the fixing unit 18 configured above, the halogen heater HH heats the heating roller 41. The toner image which has been transferred on the sheet 3 is thermally fixed on the sheet 3 while passing between the heating roller 41 and the pressure roller 42. Then, the sheet 3 is transferred into a discharging path 44 by the transfer roller 200 and the pinch roller 300. The sheet 3 transferred in the discharging path 44 is discharged onto a discharging tray 46 by a discharging roller 45.

2. Structure of Conveying a Recording Sheet After a Heating Roller

The structure of the transfer roller 200, the pinch roller 300, and the closing member 400 will be described.

Figure 2:
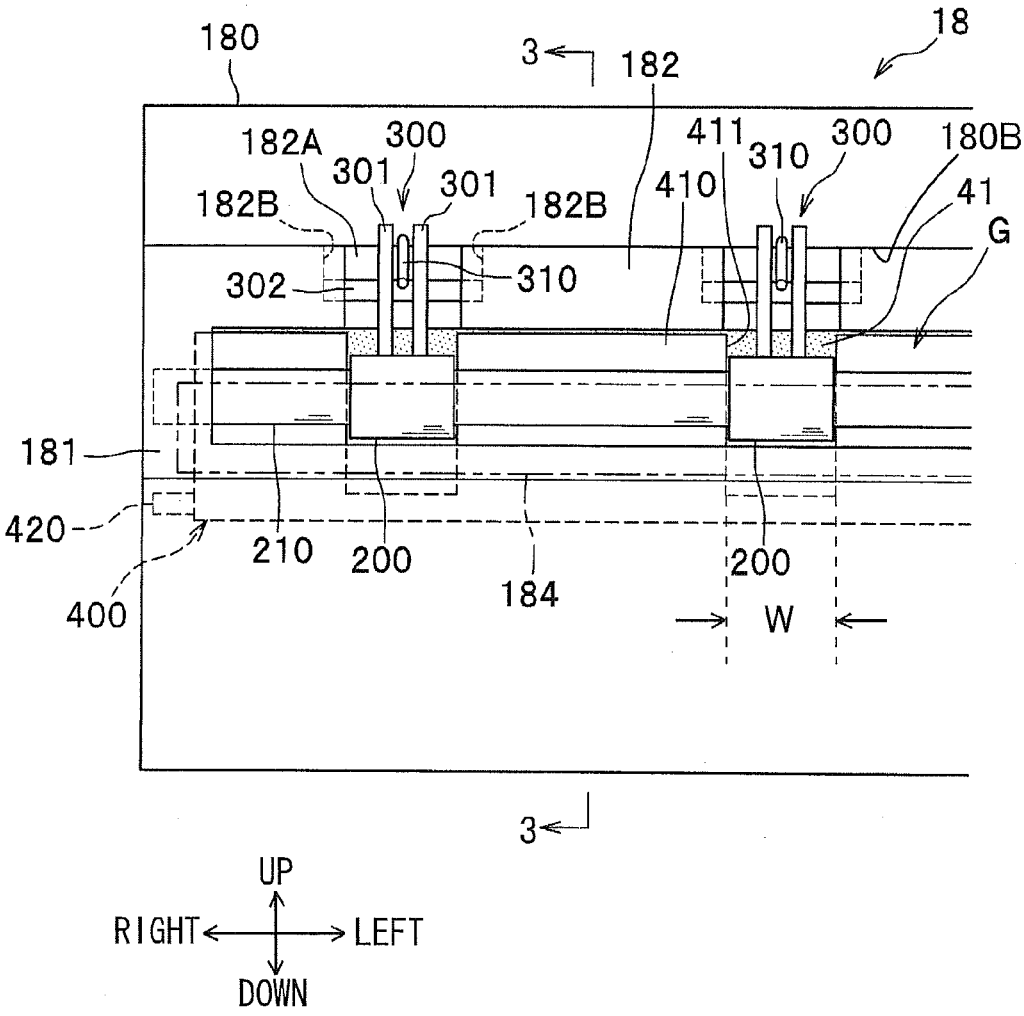
FIG. 2 is a back side view showing a fixing device when viewed from a rear side of the image forming device.

As shown in FIG. 2, the transfer roller 200 has a width narrower than the width of the sheet 3. A plurality of transfer rollers 200 are arranged at intervals in the horizontal left direction (the width direction of the sheet 3). Each transfer roller 200 is formed in a cylindrical shape. A shaft portion 210 is provided so as to be coaxial with each of the transfer rollers 200. The shaft portion 210 penetrates the plurality of transfer rollers 200 coaxially to support each the plurality of transfer rollers 200.

Figure 3A:
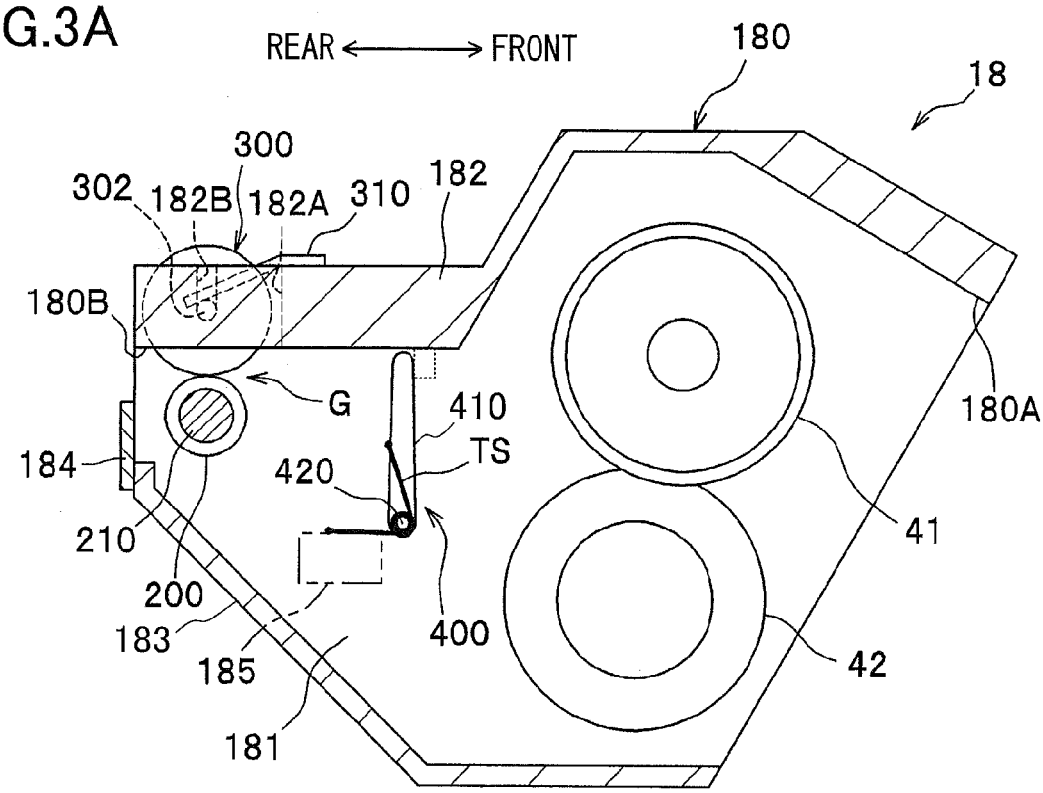
FIG. 3A is a sectional view of a shielding assembly taken along the line 3-3 in which the shielding assembly is at a first position.

The shaft portion 210 is rotatably supported to right and left side wall portions 181 of the frame 180 of the fixing unit 18. As shown in FIGS. 2 and 3A, the shaft portion 210 is arranged so as to face an upper wall portion 182 of the frame 180 in the vertical direction. Thereby, a gap G is defined between the shaft portion 210 and the upper wall portion 182 of the frame 180, which is the member facing the shaft portion 210. Accordingly, the sheet 3 which has passed between the heating roller 41 and the pressure roller 42 is transferred into the gap G, passes between the transfer roller 200 and the pinch roller 300, and then is transferred into the discharging path 44.

Now, as shown in FIG. 3A, the frame 180 is formed in a substantially tubular shape including the right and left side wall portions 181, the upper wall portion 182, and a lower wall portion 183. Additionally, openings 180A and 180B for passing the sheet 3 therethrough are formed in the front and rear sides of the frame 180, respectively. The opening 2A (see FIG. 1) of the main housing 2, the rear opening 180B of the frame 180, the gap G, and the heating roller 41 are substantially aligned. Thereby, the heating roller 41 faces the opening 2A through the gap G and the opening 180B. In other words, the heating roller 41 is exposed to the opening 2A through the gap G.

Meanwhile, the lower portion of the rear opening 180B of the frame 180 is covered with a closure plate 184. Specifically, the closure plate 184 has a size and shape covering a gap defined between the shaft portion 210 and the lower wall portion 183 (a lower edge of the opening 180B) of the frame 180.

As shown in FIG. 2, the plurality of pinch rollers 300 are provided for the plurality of transfer rollers 200, respectively, and arranged above the respective transfer rollers 200. Each of the pinch rollers 300 is configured to include a pair of disc-shaped roller main portions 301 arranged at an interval with each other, and a rotary shaft portion 302 formed integrally with the roller main portions 301 so as to connect the centers of the roller main portions 301.

As shown in FIGS. 2 and 3A, a cutout 182A is formed in the upper wall portion 182 of the frame 180 so as to be open in the vertical direction and extend from the rear face to the front of the upper wall portion 182. In each of the right and left inner faces of the cutout 182A, a supporting groove 182B is formed so as to be open to the inner side and extend vertically. The pinch roller 300 is positioned in the corresponding cutout 182A of the frame 180.

Both ends of the rotary shaft portion 302 of the pinch roller 300 are rotatably supported by the pair of supporting grooves 182B. A wire spring 310 is provided on the upper face of the upper wall portion 182 of the frame 180, to urge the rotary shaft portion 302 of the pinch roller 300 to the bottoms of the pair of supporting grooves 182B.

Figure 3B:
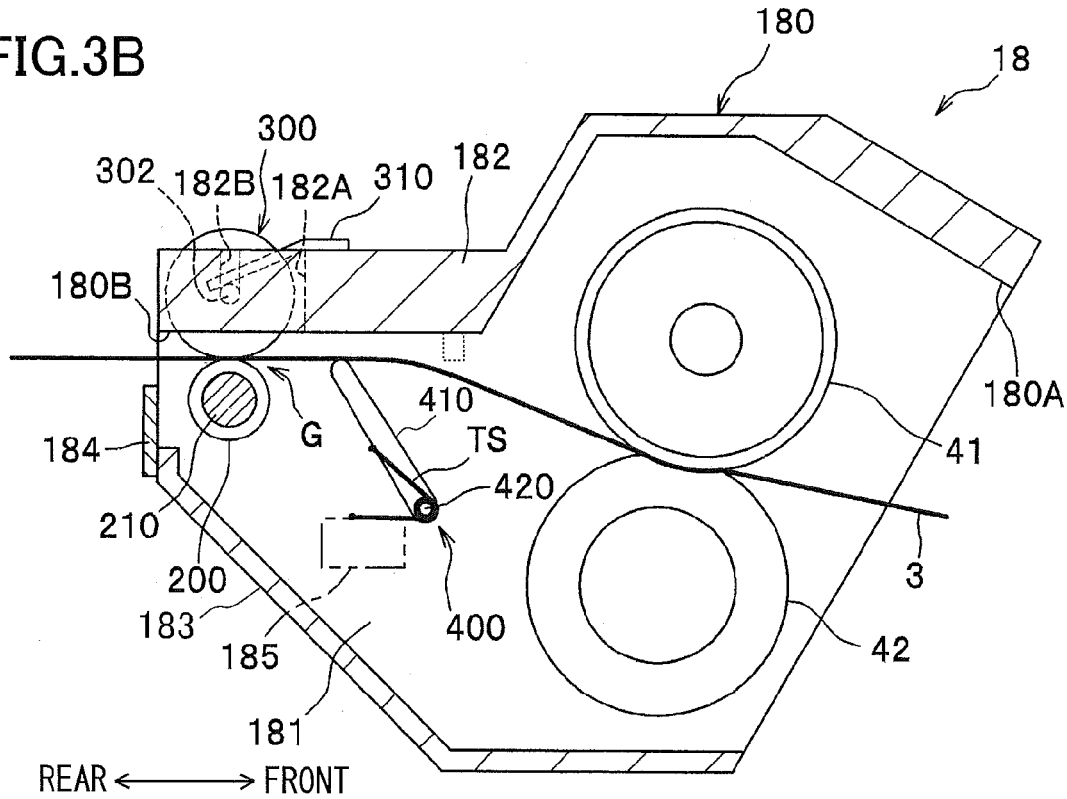
FIG. 3B is a sectional view of the shielding assembly taken along the line 3-3 in which the shielding assembly is at a second position and a recording sheet is being conveyed.

A shielding assembly 400 is positioned between the transfer rollers 200 and the heating roller 41, and movable to a first position at which at least a part of the shielding assembly 400 hides the heating roller 41 when viewed from the opening 2A or the opening 180B (see FIG. 3A), and a second position at which the heating roller 41 is exposed to the opening 180B or 2A through the gap G (see FIG. 3B). In other words, at the first position, at least a part of the shielding assembly 400 is aligned with the gap G in the sheet conveying direction. At the second position, the shielding assembly 400 is offset from the gap G in the sheet conveying direction. At the second position, the shielding assembly 400 does not interfere with a passage of the sheet 3 to the transfer roller 200.

Referring to FIG. 2, when the shielding assembly 400 is at the first position, the gap G is shielded by the shielding assembly 400 at a maximum when viewed from the opening 180B. And, most part of the heating roller 41 is not viewed through the opening 180B. Thus, the heating roller 41 indicated by dots in FIG. 2 is maximally hidden by the shielding assembly 400.

On the other hand, when the shielding assembly 400 is at the second position, the gap G is not shielded by the shielding assembly 400 when viewed from the opening 180B.

Figure 4:
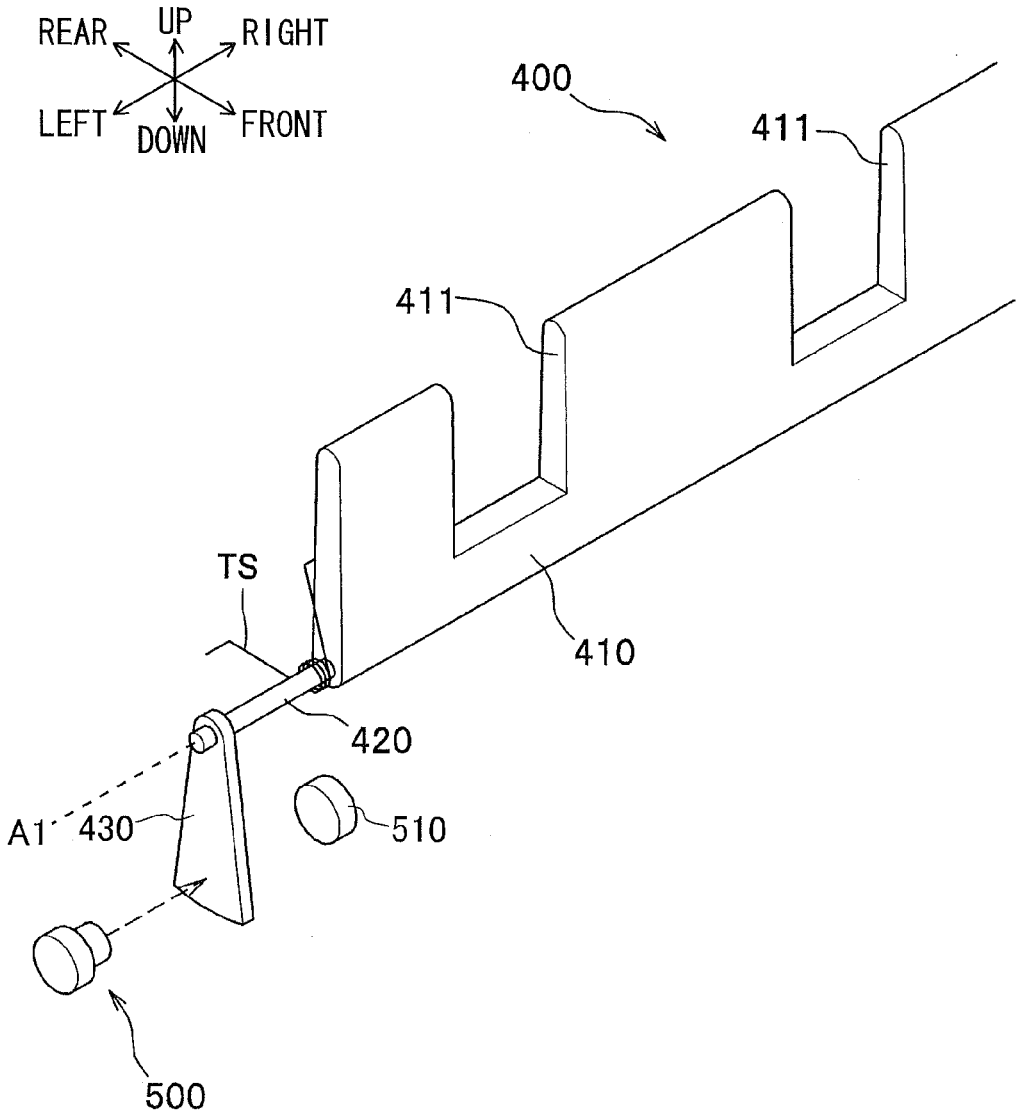
FIG. 4 is a perspective view showing a shielding assembly.

As shown in FIG. 4, the shielding assembly 400 includes a plate-shaped portion 410 extending in a direction perpendicular to the sheet conveying direction, a pair of shaft portions 420 projecting from the lateral faces of the plate-shaped portion 410 in the horizontal direction, a light shielding plate 430 provided in one end of the shaft portion 420, and a torsion spring TS. FIG. 4 shows only one shaft portion 420.

As shown in FIG. 2, the plate-shaped portion 410 is formed so as to have a substantially rectangular shape and size shielding the gap G when viewed from the opening 180B. The plate-shaped portion 410 has a plurality of cutouts 411 at positions corresponding to the plurality of transfer rollers 200. Each cutout 411 has the same width as the width of the transfer roller 200 in the horizontal direction. This structure of the cutouts 411 reduces the weight of the plate-shaped portion 410.

In the gap G, at areas where the transfer rollers 200 are positioned, the height of the gap G viewed from the opening 180B is shortened by the corresponding transfer roller 200 and the pinch roller 300 paired therewith. Therefore, when dust comes to enter from the outside of the main housing 2 in the frame 180 through the gap G, the transfer rollers 200 interferes the entry of the dust through the gap G.

Each shaft portion 420 has an axis A1. The pair of the shaft portions 420 is coaxial with each other with intervening the plate-shaped portion 410 therebetween. The shaft portions 420 are formed integrally with the plate-shaped portion 410. The pair of the shaft portions 420 is pivotably movable about the axis A1 and supported to the frame 180 of the fixing unit 18.

As shown in FIG. 3A, the torsion spring TS is provided to the shaft portion 420. One end of the torsion spring TS is fixed to a supporting portion 185 of the frame 180, and another end of the torsion spring TS is engaged to the plate-shaped portion 410. Accordingly, the torsion spring TS urges the plate-shaped portion 410 to pivot about the axis A1 of the shaft portions 420 to the first position. Thereby, the shielding assembly 400 or the plate-shaped portion 410 is normally maintained at the first position. Specifically, the plate-shaped portion 410 is pivoted about the axis A1 of the shaft portions 420 by an urging force of the torsion spring TS and brings into contact with a portion of the frame 180 (not shown) at the first position, thereby regulating the pivoting of the plate-shaped portion 410.

As shown in FIG. 3B, the plate-shaped portion 410 is pivoted about the axis A1 of the shaft portions 420 against the urging force of the torsion spring TS to the second position by the sheet 3 transferred from the heating roller 41 to the transfer roller 200.

The light shielding plate 430 is formed integrally with the shaft portion 420. The light shielding plate 430 is pivotable about the axis A1 of the shaft portion 420. The light shielding plate 430 shields light from a photosensor 500 when the plate-shaped portion 410 is positioned at the first position. A light receiver 510 is provided to receive the light from the photosensor 500. The light shielding plate 430 does not interfere with the light from the photosensor 500 to the light receiver 510 when the plate-shaped portion 410 is positioned at the second position. Therefore, a passage of the sheet 3 can be detected due to the movement of the light shielding plate 430, i.e., the shielding assembly 400. In this embodiment, the shielding assembly 400 also functions as a sheet detecting unit for detecting passage of the sheet 3 from the heating roller 41 to the transfer roller 200. Accordingly, the shielding assembly 400 (the plate-shaped portion 410) and the sheet detecting unit are integrally configured in this embodiment.

Next, the motions of the shielding assembly 400 will be described.

Since the laser printer 1 does not carry the sheet 3 when not forming an image, the shielding assembly 400 is not pushed by the sheet 3, and maintained at the first position by the urging force of the torsion spring TS, as shown in FIG. 3A. Under this condition, the gap G between the shaft portion 210 and the upper wall portion 182 in the frame 180 is shielded by the shielding assembly 400, when viewed from the opening 2A, as shown in FIG. 2. In other words, at least a part of the shielding assembly 400 is aligned with the gap in the sheet conveying direction. The heating roller 41 is hidden by the shielding assembly 400 when viewed from the opening 2A, and not exposed to the opening 2A through the gap G. Accordingly, even if a user opens the rear cover 100 from the main housing 2, as shown in FIG. 1, this structure ensures to prevent entry of dust from the outside of the main housing 2 to the heating roller 41.

When the laser printer 1 forms an image, the shielding assembly 400 is pushed by the sheet 3 against the urging force of the torsion spring TS downstream of the sheet conveying direction and then pivots about the axis A1 backwards, as shown in FIG. 3B. Simultaneously, the light shielding plate 430 is pivoted about the axis and moved out of the optical path of the photosensor 500. Thereby, the shielding assembly 400 does not interrupt carrying the sheet 3, and the passage of the sheet 3 from the heating roller 41 to the transfer roller 200 is detected by the photosensor 500. After the sheet 3 finishes passing through the transfer roller 200, the shielding assembly 400 returns to the first position due to the urging force of the torsion spring TS.

According to the above-described embodiment, the following advantageous effects can be provided.

The gap G between the shaft portion 210 and the upper wall portion 182 of the frame 180 can be shielded by the shielding assembly 400, which can thereby reduce adhesion of dust or foreign substances to the heating roller 41 and deterioration in an image quality.

In the above embodiment, the shielding assembly 400 is moved from the first position shielding the gap G to the second position by the sheet 3 transferred to the discharging path 44. Thereby, a drive source such as a motor is not necessary in order to move the shielding assembly 400, which leads to the reduction of the cost for manufacturing the laser printer 1.

The weight of the shielding assembly 400 can be reduced due to the cutout 411 of the plate-shaped portion 410 corresponding to the transfer rollers 200, while preventing adherence of dust onto the heating roller 41. Additionally, the above reduction in the weight enables the shielding assembly 400 to appropriately return to the first position even if the urging force of the torsion spring TS is set to lower level. This structure contributes to smooth conveyance of the sheet 3, because the conveyed sheet 3 needs to press the shielding assembly 400 against the urging force of the torsion spring TS and pass over the shielding assembly 400 to reach the transfer roller 200.

The shielding assembly 400 and the sheet detecting unit are integrally configured. This structure contributes to reduce the number of parts and costs for manufacturing the laser printer 1.

The present invention is not restricted by the above-described embodiment, and can be used in exemplary various forms as described below.

Figure 5:
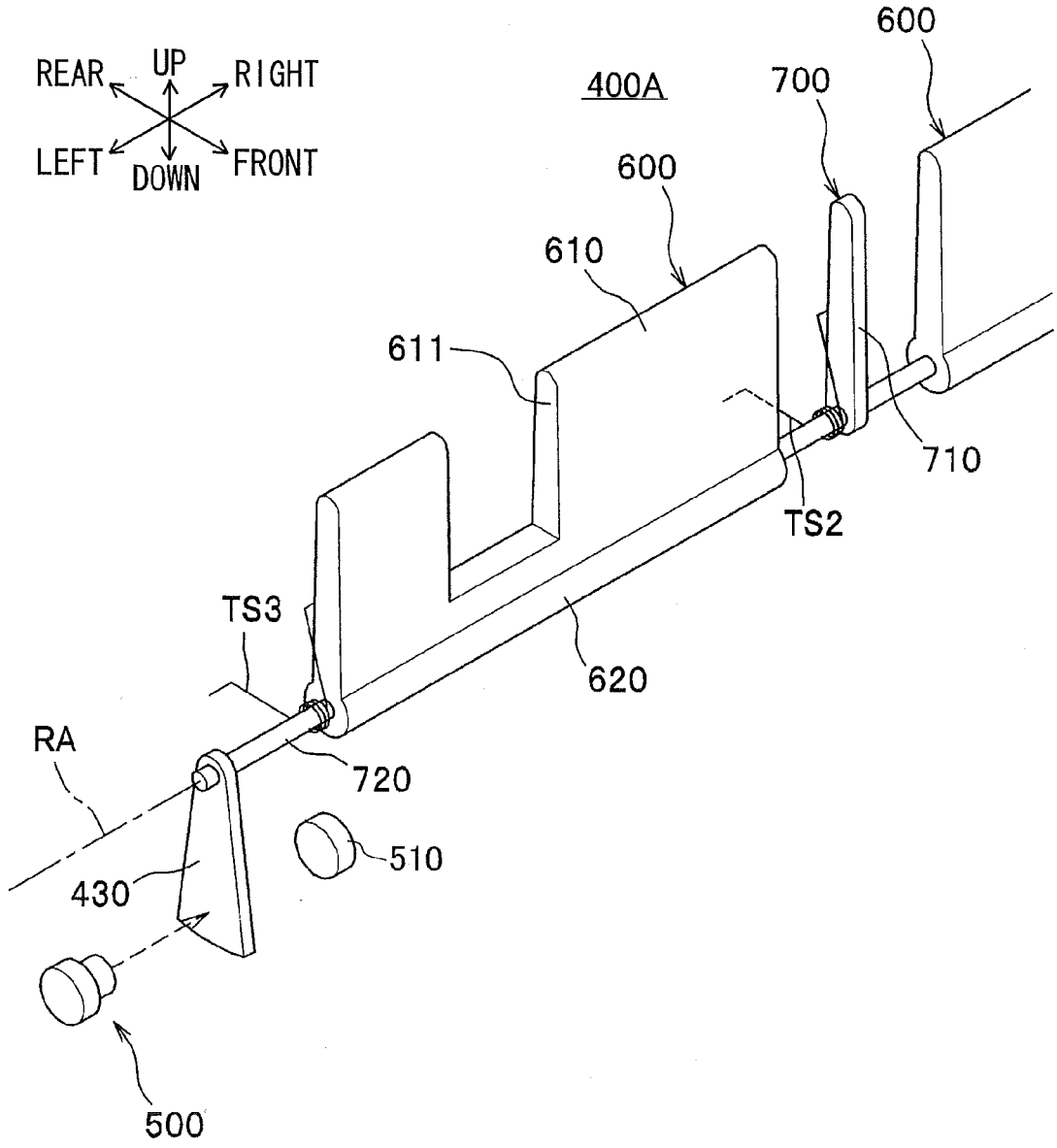
FIG. 5 is a perspective view showing a modification of the shielding assembly.

FIG. 5 shows another embodiment of the shielding assembly 400. In this embodiment, the shielding assembly 400 is divided into a shielding plate 600 and a sheet-detecting unit 700. The shielding plate 600 and the sheet-detecting unit 700 are configured to be pivotable separately from each other.

The sheet-detecting unit 700 includes an arm portion 710, a shaft portion 720, the light shielding plate 430. The light shielding plate 430 is the same as that shown in FIG. 4. The shaft portion 720 extends in the direction perpendicular to the sheet conveying direction, and is pivotably movable about an axis RA and supported to the frame 180 of the fixing unit 18. The arm portion 710 is formed integrally with the shaft portion 720 so as to extend in the radial direction from the center of the shaft portion 720. The shaft portion 720 is pivotable about the axis RA. Additionally, the light shielding plate 430 is provided integrally at one end of the shaft portion 720. Therefore, when the arm portion 710 is pushed by the sheet 3, the light shielding plate 430 also pivots about the shaft portion 720 to detect a passage of the sheet 3.

The arm portion 710 is normally urged by a second torsion spring TS2 to the first position (the position across a carrying path of the sheet 3). Specifically, the arm portion 710 intends to pivot upstream of the sheet conveying direction by the urging force of the second torsion spring TS2. The pivoting of arm portion 710 is restricted by the portion of the frame 180 (not shown).

Now, the arm portion 710 of the sheet-detecting unit 700 is formed smaller and lighter, compared with the plate-shaped portion 410 of the shielding assembly 400. Therefore, even if the urging force of the second torsion spring TS2 is smaller than that of the torsion spring TS for the plate-shaped portion 410, the sheet-detecting unit 700 can appropriately returns to the first position after the sheet 3 passes through the shielding assembly 400A.

The shielding assembly 400A includes two shielding plates 600 provided so as to interpose the arm portion 710 along the shaft portion 720. Each shielding plate 600 includes a plate-shaped portion 610 shielding the gap G and a tubular portion 620 pivotably supported around the shaft portion 720. The shielding plate 600 and the arm portion 710 are configured to be pivotable about the common axis RA of the shaft portion 720 separately from each other.

A cutout 611 similar to the cutout 411 is formed in the plate-shaped portion 610. Preferably, the arm portion 710 of the sheet-detecting unit 700 is arranged on the shaft portion 720 at a position confronting the transfer roller 200. The distance between the two shielding plates 600 is set to be equal to the width of the transfer roller 200. Thereby, a space between the two shielding plates 600 can be appropriately shielded by the transfer roller 200 in the sheet conveying direction.

The shielding plate 600 is normally urged by a third torsion spring TS3 to the first position. Specifically, the shielding plate 600 is pivoted by the urging force of the third torsion spring TS3, and positioned at the first position, because a part of the shielding plate 600 comes into contact with a part of the frame 180 (not shown) to thereby regulate the pivoting of the shielding plate 600.

In this embodiment, the shielding plate 600 does not need to be returned to the first position, similarly to the sheet-detecting unit 720 every time the sheet 3 is passed through the shielding assembly 400A, because the shielding plate 600 is separate from the sheet-detecting unit 700. Thereby, the urging force of the third torsion spring TS3 can be set to be smaller than the urging force of the second torsion spring TS2. Accordingly, the shielding plate 600 can be easily pressed down due to the passage of the sheet 3.

According to the above-described structure, since the sheet-detecting unit 700 is urged to the initial position by urging force of the second torsion spring TS2 which can be set to be higher than that of the third torsion spring TS3, the sheet-detecting unit 700 can be configured to be readily returned. Additionally, since the urging force of the third torsion spring TS3 can be set to be lower than that of the second torsion spring TS2, pressing force of the sheet 3 can readily topple the shielding plate 600.

In the above-described embodiment, the torsion springs TS and TS3 return the shielding assembly 400 to the first position, but the present invention is not restricted by this structure. For example, the tip of the plate-shaped portion may be arranged so as to be directed downward, or a weight may be provided so as to droop downward from the plate-shaped portion. Thus, the shielding assembly 400 is positioned at the second position by the assistance of the weight. Alternatively, the shielding plate 600 may be operationally connected to a drive source such as a motor through a gear system, and thereby switched between the first and the second positions by a drive force from the drive source.

In the above-described embodiment, the torsion spring TS is employed as the urging member. Alternatively, a plate spring, a coil spring, or the like may also be employed.

In the above-described embodiment, the plate-shaped portion 410 and the plate-shaped portion 610 have the plurality of cutouts 411 and 611, respectively. Alternatively, the plate-shaped portion 410 and the plate-shaped portion 610 without any cutouts can be used.

In the above-described embodiment, the shielding assembly 400 is provided between the transfer rollers 200 and the heating roller 41. Alternatively, the shielding assembly 400 may be provided between the rear cover 100 and the transfer rollers 200 in the frame 180.

In the above-described embodiment, the shaft portion 210 faces the upper wall portion 182 through the gap G. Alternatively, the gap G for passing the sheet 3 may be provided between the shaft portion 210 and the lower wall portion 183.

In the above-described embodiment, the rear cover 100 is employed as the cover. Alternatively, a front cover of the main casing 2 may be employed as the cover.

In the above-described embodiment, the heating roller 41 is employed as the heating member. Alternatively, a cylindrical fixing film slidably supported by a guide may be employed.

In the above-described embodiment, the present invention is applied to the laser printer. Alternatively, the present invention may be applied to as a copier, a multi-function device or any type of image forming devices.

In the above-described embodiment, the sheet 3 such as cardboard, a postcard, or thin paper is employed as the exemplary recording sheet. Alternatively, an OHP sheet may be employed as the recording sheet.

What is claimed is:

1. An image forming device comprising:

a housing having an opening;

a cover configured to open and close the opening;

a heating member configured to heat a recording sheet;

a plurality of transfer rollers positioned between the heating member and the opening of the housing and configured to rotate and convey the recording sheet in a sheet conveying direction, the plurality of transfer rollers being positioned downstream of the heating member in the sheet conveying direction, the plurality of transfer rollers being positioned at a distance in a predetermined direction perpendicular to the sheet conveying direction, the distance defining a gap between neighboring transfer rollers, the heating member positioned so that the opening is on the other side of the gap than the heating member in the sheet conveying direction;

a first shaft configured to rotate about a first axis extending in the predetermined direction, the first shaft supporting the plurality of transfer rollers; and an elongated shielding member elongated in the predetermined direction and configured to pivot between a first position where the elongated shielding member covers at least a part of the gap and a second position where the elongated shielding member covers less of the gap than when in the first position, wherein the elongated shielding member comprises a first plate portion configured to pivot about a second axis between the first position and the second position, the first plate portion having a cutout portion at a position confronting the plurality of transfer rollers in the sheet conveying direction.

2. The image forming device according to claim 1, further comprising a frame provided in the housing, wherein the frame has a first opening and a second opening arranged in the sheet conveying direction, the second opening faces the opening of the housing, and the heating member is positioned in a proximity to the first opening.

3. The image forming device according to claim 1, further comprising a frame provided in the housing, wherein the first shaft is supported by the frame.

4. The image forming device according to claim 1, further comprising a frame provided in the housing, wherein the elongated shielding member further comprises:

a second shaft configured to pivot about the second axis extending in the predetermined direction and supported by the frame; and a first elastic member configured to urge the first plate portion to the first position;

wherein the first plate portion is responsive to movement of the second shaft, and configured to move from the first position to the second position when the recording sheet conveyed from the heating member to the plurality of transfer rollers contacts the first plate portion.

5. The image forming device according to claim 1, wherein the elongated shielding member is positioned between a heating roller and the plurality of transfer rollers.

6. The image forming device according to claim 4, wherein the elongated shielding member further comprises:

a second plate portion configured to pivot about the second axis between the first position and the second position, the second plate portion being configured to pivot when the recording sheet conveyed from the heating member to the plurality of transfer rollers contacts the second plate portion; and a second elastic member that urges the second plate portion to the first position.

7. The image forming device according to claim 4, further comprising:

a detecting unit configured to detect a passage of the recording sheet between the heating member and the plurality of transfer rollers, wherein the detecting unit comprises:

a detected plate portion responsive to movement of the second shaft and configured to pivot about the second axis; and an optical detector configured to detect the passage of the recording sheet by a movement of the detected plate.

8. The image forming device of claim 1, wherein the first plate portion comprises a plurality of cutout portions at positions aligned with the plurality of transfer rollers, respectively.

9. A fixing device for fixing an image on a recording sheet, comprising:

a frame having a first opening and a second opening;

a heating member configured to heat the recording sheet;

a plurality of transfer rollers positioned between the heating member and the second opening and configured to rotate and convey the recording sheet in a sheet conveying direction, the plurality of transfer rollers being positioned downstream of the heating member in the sheet conveying direction and at a distance in a predetermined direction perpendicular to the sheet conveying direction, the distance defining a gap between neighboring transfer rollers, the heating member positioned so that the second opening is on the other side of the gap than the heating member in the sheet conveying direction;

a first shaft configured to rotate about an axis extending in the predetermined direction, the first shaft supporting the plurality of transfer rollers; and an elongated shielding member elongated in the predetermined direction and movable between a first position where the elongated shielding member covers at least a part of the gap and a second position where the elongated shielding member covers less of the gap than when in the first position, wherein the elongated shielding member comprises a first plate portion configured to pivot about a second axis between the first position and the second position, the first plate portion having a cutout portion at a position confronting the plurality of transfer rollers in the sheet conveying direction.

10. The fixing device according to claim 9, wherein the first shaft is supported by the frame.

11. The fixing device according to claim 9, wherein the elongated shielding member comprises:

a second shaft configured to pivot about the second axis extending in the predetermined direction and supported by the frame; and a first elastic member configured to urge the first plate portion to the first position;

wherein the first plate portion is responsive to movement of the second shaft, and configured to move from the first position to the second position when the recording sheet conveyed from the heating member to the plurality of transfer rollers contacts the first plate portion.

12. The fixing device according to claim 9, wherein the elongated shielding member is positioned between a heating roller and the plurality of transfer rollers.

13. The fixing device of claim 9, wherein the first plate portion comprises a plurality of cutout portions at positions aligned with the plurality of transfer rollers, respectively.

14. A fixing device for fixing an image on a recording sheet, a frame having a first opening and a second opening;

a heating member configured to heat the recording sheet;

a plurality of transfer rollers positioned between the heating member and the second opening and configured to rotate and convey the recording sheet in a sheet conveying direction, the plurality of transfer rollers being positioned downstream of the heating member in the sheet conveying direction and at a distance in a predetermined direction perpendicular to the sheet conveying direction, the distance defining a gap between neighboring transfer rollers, the heating member positioned so that the second opening is on the other side of the gap than the heating member in the sheet conveying direction;

a first shaft configured to rotate about an axis extending in the predetermined direction, the first shaft supporting the plurality of transfer rollers; and an elongated shielding member elongated in the predetermined direction and movable between a first position where the elongated shielding member covers at least a part of the gap and a second position where the elongated shielding member covers less of the gap than when in the first position, wherein the elongated shielding member comprises:

a second shaft configured to pivot about a second axis extending in the predetermined direction and supported by the frame;

a first plate portion responsive to movement of the second shaft and configured to pivot about the second axis between the first position and the second position, the first plate portion being configured to move from the first position to the second position when the recording sheet conveyed from the heating member to the plurality of transfer rollers contacts the first plate portion;

a first elastic member configured to urge the first plate portion to the first position;

a second plate portion configured to pivot about the second axis between the first position and the second position, the second plate portion being configured to pivot when the recording sheet conveyed from the heating member to the plurality of transfer rollers contacts the second plate portion; and a second elastic member configured to urge the second plate portion to the first position.

15. The fixing device according to claim 11, further comprising:

a detecting unit configured to detect a passage of the recording sheet between the heating member and the plurality of transfer rollers, wherein the detecting unit comprises:

a detected plate portion responsive to movement of the second shaft and configured to pivot about the second axis between the first position and the second position; and an optical detector configured to detect the passage of the recording sheet by a movement of the detected plate.

* * * * *